US005458250A

United States Patent [19]

Martinez

[11] Patent Number: 5,458,250

[45] Date of Patent: Oct. 17, 1995

[54] BUOYANT CRANE

[76] Inventor: Elio R. Martinez, 75 N. Clinton St., East Orange, N.J. 07017

[21] Appl. No.: 291,295

[22] Filed: Aug. 16, 1994

[51] Int. Cl.[6] ..... B66D 1/08

[52] U.S. Cl. ..... 212/271; 254/360

[58] Field of Search ..... 212/190, 271; 114/44, 45, 46, 47, 48, 49, 50, 51, 52, 53, 54, 55; 254/324, 360, 93 HP

[56] References Cited

U.S. PATENT DOCUMENTS

| | | | |
|---|---|---|---|
| 1,832 | 10/1840 | Bell | 114/44 |
| 9,274 | 12/1835 | Atkinson et al. | 114/52 |
| 1,264,257 | 4/1918 | Beckwith | 114/49 |
| 1,303,912 | 5/1919 | Katayama | 114/54 |
| 2,000,746 | 5/1935 | Dray . | |
| 2,213,375 | 9/1940 | Barna . | |
| 2,313,215 | 3/1943 | Bierlee . | |
| 2,374,296 | 4/1945 | Ming . | |
| 2,470,312 | 5/1949 | Levin . | |
| 2,887,080 | 5/1959 | Fedrowich . | |
| 2,935,024 | 5/1960 | Kofahl . | |
| 3,895,592 | 7/1975 | King | 114/45 |
| 3,961,479 | 6/1976 | Anderson . | |
| 3,970,415 | 7/1976 | Widecrantz et al. . | |
| 4,208,877 | 6/1980 | Evans et al. . | |
| 4,233,813 | 11/1980 | Simmons . | |
| 4,267,695 | 5/1981 | Micciche . | |
| 4,325,216 | 4/1982 | Mermis . | |
| 4,326,132 | 4/1982 | Bokel . | |
| 4,674,281 | 6/1987 | Kim et al. . | |
| 4,718,232 | 1/1988 | Willmouth . | |
| 4,726,188 | 2/1988 | Woolfolk . | |
| 4,742,242 | 5/1988 | De Shon . | |
| 4,754,157 | 6/1988 | Windle . | |
| 4,805,406 | 2/1989 | Grsetic . | |
| 5,016,551 | 5/1991 | Peck et al. . | |

FOREIGN PATENT DOCUMENTS

| | | | |
|---|---|---|---|
| 477739 | 11/1915 | France . | |
| 157782 | 12/1982 | Germany | 114/45 |
| 485540 | 10/1953 | Italy . | |
| 510058 | 1/1955 | Italy . | |
| 1615043 | 12/1990 | U.S.S.R. | 114/45 |

*Primary Examiner*—William E. Terrell
*Assistant Examiner*—Thomas J. Brahan
*Attorney, Agent, or Firm*—Rosen, Dainow & Jacobs

[57] ABSTRACT

A buoyant crane is disclosed which moves loads that are entirely out of a liquid body such as water, in response to buoyant forces acting on an expandable and contractible chamber located in the liquid body. Buoyant forces acting on the chamber are produced in relation to the volume of the chamber. The chamber is movably supported in the liquid body so that it may rise and sink in accordance with buoyant forces acting on the chamber responsive to changes in the volume of the chamber. A compressed gas source supplies compressed gas (e.g., air) to the chamber to selectively change its volume. A rope and pulley system couples the chamber to a load for moving the load, which is entirely out of the liquid body, in response to movement of the chamber within the liquid body in turn responsive to the buoyant forces acting on the chamber. A support structure supports the rope and pulley system such that the chamber is movable in the body of liquid in response to changes in the volume defined by the chamber to move loads which are entirely out of the liquid.

20 Claims, 1 Drawing Sheet

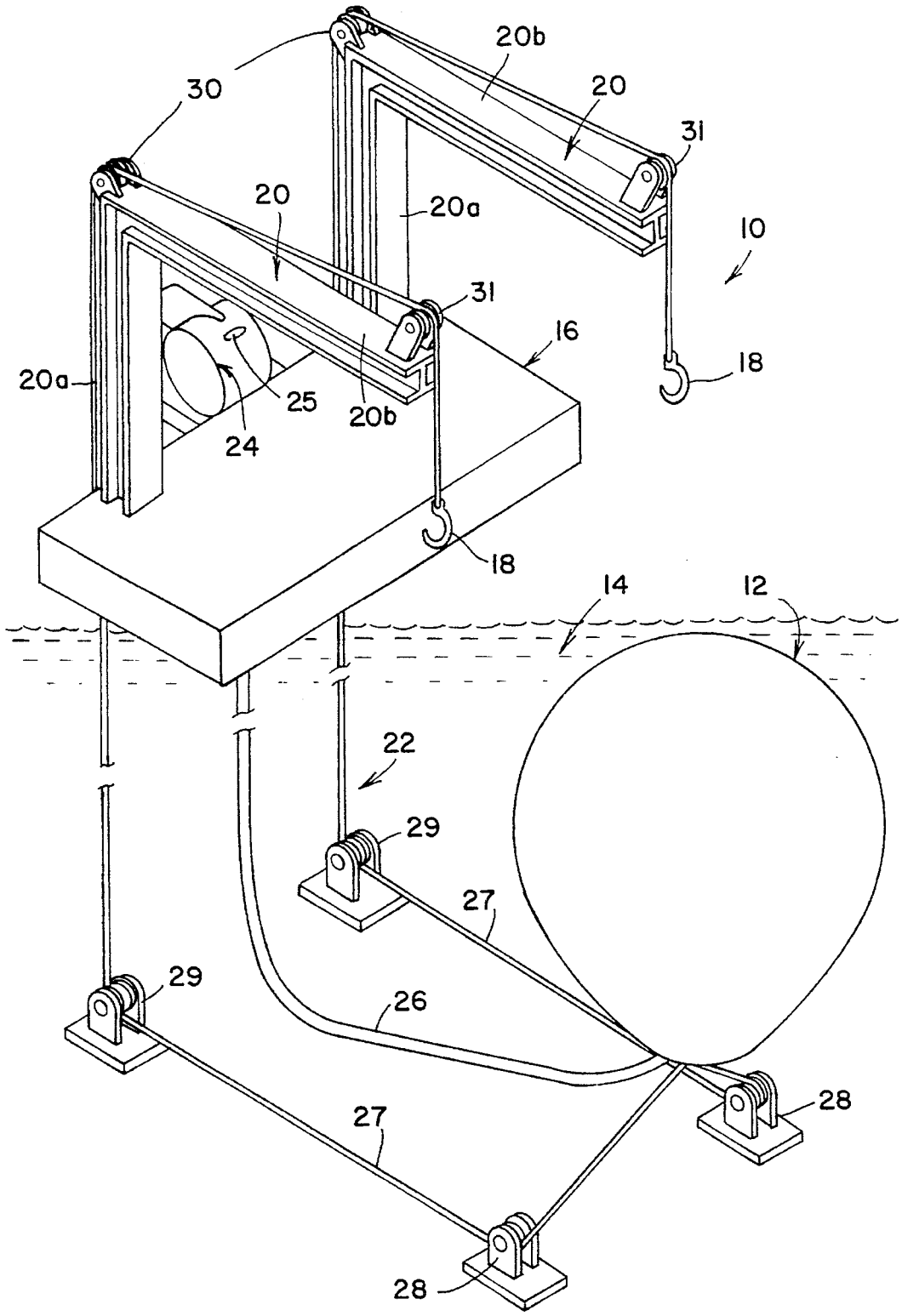
30
20b
20
31
20
20a
10
31
16
18
20a
25
20b
24
18
14
12
22
29
27
29
26
28
27
28

BUOYANT CRANE

BACKGROUND OF THE INVENTION

The invention disclosed herein relates to hoisting apparatus in general, and in particular to hoisting apparatus which employs buoyant forces generated within a liquid body to move loads outside of the liquid body.

U.S. Pat. No. 5,016,551 (Peck et al.) discloses a lift for water vehicles which utilizes a tank situated in the water below a vehicle to lift the vehicle out of the water by displacing water within the tank with air. U.S. Pat. No. 2,313,215 (Bierlee) discloses apparatus for raising submerged vessels which utilizes collapsed bags that are inflated to produce the buoyancy to raise the vessel. Both of those patents are directed to lifting vessels in water.

U.S. Pat. No. 2,470,312 (Levin) discloses a reciprocal buoyancy lift which utilizes buoyancy to move compartments in two spaced housings which are almost entirely submerged in a body of fluid. A compartment in a first of the two housings has a fixed buoyancy and the buoyancy of a compartment in a second housing may be selectively changed by introducing therein or venting therefrom compressed air. The compartments in the two housings are selectively communicated to selectively transfer fluid therebetween. After compressed air is introduced into or vented from the compartment in the second housing, and that compartment moves up or down, respectively, fluid is selectively transferred between the compartments so that they mutually assist each other in moving in opposite directions. The lift disclosed in the Levin '312 Patent is relatively complicated, and as disclosed does not appear to be suited for moving loads entirely outside of the fluid body.

There is a need for simplified apparatus which uses buoyant forces to move loads outside of the liquid body in which the buoyant forces are generated.

OBJECTS AND SUMMARY OF THE INVENTION

It is an object of the invention disclosed herein to provide simplified apparatus for moving loads which utilizes buoyant forces in a body of liquid to move a load outside the body of liquid.

It is another object of the invention to provide such apparatus configured to operate as a crane or hoist.

The above and other objects are achieved in apparatus constructed in accordance with the invention which includes a chamber defining a changeable volume located in a body of liquid so as to generate buoyant forces acting on the chamber which are related to the volume of the chamber, means for selectively changing the volume of the chamber, and means coupled to the chamber for moving a load in response to the buoyant forces acting on the chamber. The chamber displaces liquid in the liquid body in relation to the volume defined by the chamber to produce the buoyant forces that act on the chamber.

In the preferred embodiment, the means coupled to the chamber for moving a load comprises a support structure supported out of the liquid body, means for engaging a load, and means for coupling the engaging means, the support structure and the chamber such that the chamber is movable in the body of liquid in response to changes in the volume defined by the chamber, and so that the engaging means moves relative to the support structure in response to movement of the chamber in the body of liquid. The coupling means couples the chamber so that it moves vertically in the body of liquid, and the coupling means and the support structure are constructed to move the engaging means vertically when the chamber moves vertically. A rope (wire rope as well as natural and synthetic fiber ropes) and pulley system couples the load to the chamber, which in the illustrated embodiment causes the load to move in the same direction as the chamber. The chamber is located in a body of water above which the support structure rises, and the rope and pulley system cause a load out of the water to be lifted when the chamber rises in the water and the load to be lowered when the chamber sinks in the water. Alternatively, the chamber may be located in a body of liquid at about the same height as or above the load, and/or the rope and cable system may move the load in the direction opposite to that in which the chamber moves.

Also, in the preferred embodiment the chamber is an expandable balloon-like structure, and the means for changing the volume defined by the chamber comprises a gas compressor, a supply of a compressible gas (preferably air) sufficient to expand the chamber to define a predetermined volume, and means communicating the gas compressor with the interior of the chamber.

BRIEF DESCRIPTION OF THE DRAWING

The invention disclosed herein is illustrated in the sole figure of the accompanying drawing which is meant to be exemplary and not limiting, which is schematic drawing of a buoyant crane according to the invention.

DESCRIPTION OF THE PREFERRED EMBODIMENT

Referring now to the drawing, a buoyant crane 10 according to the invention includes an expandable and contractible chamber 12 in the form of a balloon or bag located in a body of water 14, a support structure 16 above the body of water 14, hooks 18 (load engaging means) by means of which a load is attached to the crane 10, spaced arms 20 supported by the support structure 16 and a rope and pulley system 22 which couple the hooks to the chamber 12, and an air compressor 24 and an air hose 26 which communicates the compressor 24 with the interior of the chamber 12. Arms 20 extend horizontally, but may be sloped downwardly, e.g. at about 30°, to assist the hooks 18 to slide down to a new loading position or rest position under the action of gravity. A vent 25 which may be associated with compressor 24 is provided for selectively releasing air from chamber 12. The volume of chamber 12 changes in accordance with the pressure of the air therein, which is controlled by air compressor 24 and the vent.

In the rope and pulley system 22 depicted in the drawing, two ropes 27 and four pulleys 28–31 per rope link the hooks 18 with the chamber 12. Pulleys 28 and 29 are mounted in any suitable manner in the water body 14 below chamber 12, and pulleys 30 and 31 are mounted on arms 20 supported above the water body 12 and above chamber 12. The rope and pulley system 22 depicted in the drawing provides changes in direction of the ropes 26 so that they may be run from the chamber 12 below the water to a location above the water where the hooks may be attached to a load. The rope and pulley system 22 does not provide any mechanical advantage for lifting a load. However, it may be preferable to use rope and cable systems which provide a mechanical advantage depending upon the loads to be lifted, the power available to provide lift to chamber 12, the space available, etc.

To lift a load attached to hooks 18, compressed air is introduced into chamber 12 which causes chamber 12 to expand and rise in the water 14. To lower a load attached to hooks 18, compressed air is vented from chamber 12 which causes the chamber to shrink in volume and sink in the water. Means for regulating the introduction of compressed air into, and the venting of compressed air from chamber 12 for smoothly moving a load up or down may be conventional and are known to those of skill in the art.

The air hose 26 is of sufficient length to allow the chamber 12 to rise in the water 14 from its lowest to its highest level and is connected to the chamber 12 conventionally. While arms 20 are shown to have a vertical beam member **20*a* connected to the support structure 16, and a horizontal beam member 20*b* connected to the vertical beam member, other structures may be used to support the ropes 27 above the support structure 16 and the water 14. A guide system (not shown) may be provided to guide chamber 12** in its upward and downward movements, and to restrain horizontal movement of the chamber, e.g. if the chamber is located in a body of water in which there are currents or tides.

The support structure 16 may be a dock or pier structure located on or adjacent a body of water, or supported on land adjacent a body of water. Arms 20 may be made of steel, wood, etc., and may be connected together and to support structure 16 in a conventional manner. The ropes 27 and the pulleys 28–31 may be conventional. The support structure 16, the compressor 24 and the air hose 26 may all be conventional and are known to those of skill in the art. Chamber 12 may be made of a heavy flexible plastic, or rubber, or a reinforced fabric, in a shape similar to that of a high altitude balloon. The chamber 12 may be made of a material or materials which stretch to expand the chamber, or a non-stretchable material so that the chamber 12 is fully or partially collapsed with no or little air therein and expands as it fills, or made of both types of material. The foregoing structures may, as mentioned, be conventional and are constructed in accordance with the loads to be lifted, the environment of the body of water, the ambient environment, etc. A control system which controls raising and lowering loads may be conventionally constructed by those of skill in the art. The system for supplying and releasing compressed air to chamber 12 may be open, i.e., air is obtained from the atmosphere, compressed and supplied to chamber 12, and released to the atmosphere, or closed, i.e., the air is retained in a closed loop having a reservoir from which air to be compressed is obtained and returned after release from the chamber 12. In a closed system compressible gases other than air may be used.

If desired, chamber 12 may be located in water or another liquid held in a container, and the container may be located below the support structure and the loads to be moved, as described above, at the same level as the support structure and/or the loads to be moved, or above the support structure and/or the loads to be moved. The coupling means including the rope and pulley system and means for supporting the rope and pulley system will then be configured accordingly, as will be apparent to those of skill in the art.

While the invention has been described and illustrated in connection with preferred embodiments, many variations and modifications as will be evident to those skilled in this art may be made without departing from the spirit and scope of the invention. The invention as set forth in the appended claims is thus not to be limited to the precise details of construction set forth above as such variations and modifications are intended to be included within the spirit and scope of the invention as defined in the appended claims.

What is claimed is:

1. A buoyant crane comprising:

an expandable and contractible chamber immersed in a body of liquid and defining a correspondingly expandable and contractible volume in the body of liquid, said chamber being constructed so as to displace liquid in the liquid body in relation to the volume defined by said chamber and thereby have a buoyancy related to the volume defined by said chamber;

means for causing said chamber selectively to expand and contract and to thereby change the buoyancy of said chamber while said chamber is in the body of liquid;

a support structure; and coupling means supported at least partially by said support structure for coupling a load, which at all times is not immersed in or floating on the body of liquid and is entirely out of the body of liquid, to said chamber immersed in the body of liquid, said chamber moving in the body of liquid and the load moving entirely out of the body of liquid in response to the buoyancy of said chamber relative to the weight of the load, whereby the load may be raised and lowered entirely out of the body of liquid by expanding and contracting said chamber.

2. The buoyant crane of claim 1 wherein said coupling means couples said chamber so that it moves vertically in the body of liquid, and wherein said coupling means and said support structure are constructed to move the load vertically when said chamber moves vertically.

3. The buoyant crane of claim 1 wherein said coupling means couples said chamber so that it moves vertically in the body of liquid, and wherein said coupling means and said support structure are constructed to move said engaging means vertically when said chamber moves vertically. The buoyant crane of claim 2 wherein said coupling means and said support structure are constructed to move said engaging means vertically in the same direction as said chamber moves.

4. The buoyant crane of claim 1 wherein said coupling means comprises engaging means for engaging a load and a rope and pulley system coupling said chamber and said engaging means.

5. The buoyant crane of claim 4 wherein said coupling means and said support structure are constructed to move the load vertically in the same direction in which said chamber moves.

6. The buoyant crane of claim 3 wherein said support structure is located above said chamber, and wherein said rope and pulley system comprises a plurality of pulleys and at least one rope run through said pulleys, at least one of said pulleys being positioned below said chamber and at least one of said pulleys being supported by said support structure above said chamber.

7. A buoyant crane for moving a load over or adjacent a body of water, the load being at all times not immersed in or floating on the body of water, comprising:

an expandable and contractible chamber immersed in the body of water and defining a correspondingly expandable and contractible volume in the body of water, said chamber being constructed so as to displace water in the water body in relation to the volume defined by said chamber and thereby have a buoyancy related to the volume defined by said chamber;

means for causing said chamber selectively to expand and contract and to thereby change the volume of said chamber while said chamber is in the body of water;

a support structure rising above the body of water and said chamber;

coupling means supported at least partially by said support structure for coupling the load, which is not immersed in or floating on the body of water and is entirely out of the body of water, to said chamber immersed in the body of water, said chamber moving in the body of water and the load moving entirely out of the body of water in response to the buoyancy of said chamber relative to the weight of the load, whereby the load may be raised and lowered entirety out of the body of water by expanding and contracting said chamber, and moved over or adjacent the body of water.

8. The buoyant crane of claim 7 wherein said coupling means couples said chamber to said support structure so that said chamber moves vertically in the body of water, and wherein said coupling means and said support structure are constructed to move the load vertically when said chamber moves vertically.

9. The buoyant crane of claim 8 wherein said coupling means and said support structure are constructed to move the load vertically in the same direction in which said chamber moves.

10. The buoyant crane of claim 8 wherein said coupling means and said support structure are constructed to move said engaging means vertically in the same direction as said chamber moves.

11. The buoyant crane of claim 8 wherein said coupling means comprises engaging means for engaging the load and a rope and pulley system coupling said chamber and said engaging means.

12. The buoyant crane of claim 11 wherein said rope and pulley system comprises a plurality of pulleys and at least one rope run through said pulleys, at least one of said pulleys being positioned below said chamber and at least one of said pulleys being supported by said support structure above said chamber.

13. A buoyant crane comprising:

a chamber immersed in a body of liquid and defining therein an expandable and contractible volume of a gas, said chamber having a buoyancy related to the volume of gas defined in said chamber;

means for causing said volume of gas selectively to expand and contract and to thereby change the buoyancy of said chamber while said chamber is in the body of liquid;

a support structure; and coupling means supported at least partially by said support structure for coupling a load, which is not immersed in or floating on the body of liquid and is entirely out of the body of liquid, to said chamber immersed in the body of liquid, said chamber moving in the body of liquid and the load moving entirely out of the body of liquid in response to the buoyancy of said chamber relative to the weight of the load, whereby the load may be raised and lowered entirely out of the body of liquid by expanding and contracting said volume of gas.

14. The buoyant crane of claim 13 wherein said coupling means couples said chamber so that it moves vertically in the body of liquid, and wherein said coupling means and said support structure are constructed to move the load vertically when said chamber moves vertically.

15. The buoyant crane of claim 14 wherein said support structure is located above said chamber, and wherein said coupling means comprises a rope and pulley system including a plurality of pulleys and at least one rope run through at least one pulley and coupled to the load, at least one of said pulleys being positioned below said chamber and at least one of said pulleys being supported by said support structure above said chamber.

16. The buoyant crane of claim 13 wherein said means for causing the volume of gas in said chamber to expand and contract comprises a gas compressor, a supply of a compressible gas and means communicating said gas compressor with the interior of said chamber.

17. A buoyant crane for moving a load over or adjacent a body of water, the load being at all times not immersed in or floating on the body of water, comprising:

a chamber immersed in the body of water defining an expandable and contractible volume of gas in the body of water, said chamber having a buoyancy related to the volume of a gas in said chamber;

means for causing said volume of gas in said chamber selectively to expand and contract and to thereby change the buoyancy of said chamber while said chamber is in the body of water;

a support structure rising above the body of water and said chamber;

coupling means supported at least partially by said support structure for coupling the load, which is not immersed in or floating on the body of water and is entirely out of the body of water, to said chamber immersed in the body of water, said chamber moving in the body of water and the load moving entirely out of the body of water in response to the buoyancy of said chamber relative to the weight of the load, whereby the load may be raised and lowered entirely out of the body of water by expanding and contracting the volume of gas in said chamber, and moved over or adjacent the body of water.

18. The buoyant crane of claim 17 wherein said coupling means couples said chamber to said support structure so that said chamber moves vertically in the body of water, and wherein said coupling means and said support structure are constructed to move the load vertically when said chamber moves vertically.

19. The buoyant crane of claim 18 wherein said coupling means and said support structure are constructed to move the load vertically in the same direction in which said chamber moves.

20. The buoyant crane of claim 17 wherein said coupling means comprises a rope and pulley system including a plurality of pulleys and at least one rope run through at least one pulley and coupled to the load, at least one of said pulleys being positioned below said chamber and at least one of said pulleys being supported by said support structure above said chamber.

* * * * *